United States Patent [19]

Eylon et al.

[11] Patent Number: 4,733,816

[45] Date of Patent: Mar. 29, 1988

[54] METHOD TO PRODUCE METAL MATRIX COMPOSITE ARTICLES FROM ALPHA-BETA TITANIUM ALLOYS

[75] Inventors: Daniel Eylon, Dayton; Francis H. Froes, Xenia, both of Ohio

[73] Assignee: The United States of America as represented by the Secretary of the Air Force, Washington, D.C.

[21] Appl. No.: 936,679

[22] Filed: Dec. 11, 1986

[51] Int. Cl.[4] ..... B23K 20/00; B23K 31/00

[52] U.S. Cl. ..... 228/190; 228/234; 228/263.12; 228/263.21; 228/178; 164/477

[58] Field of Search ..... 228/190, 193–195, 228/234, 263.12, 263.21, 903, 121; 428/607, 608, 621, 627, 568, 622, 623, 631; 164/477

[56] References Cited

U.S. PATENT DOCUMENTS

| | | | |
|---|---|---|---|
| 3,991,928 | 11/1976 | Friedrich et al. | 228/190 |
| 4,010,884 | 3/1977 | Rothman | 228/190 |
| 4,406,393 | 9/1983 | Ascani, Jr. et al. | 228/157 |
| 4,411,380 | 10/1983 | McWithey et al. | 228/181 |
| 4,499,156 | 2/1985 | Smith et al. | 428/614 |

OTHER PUBLICATIONS

S. J. Savage and F. H. Froes, "Production of Rapidly Solidified Metals and Alloys", Journal of Metals, vol. 36, No. 4, Apr. 1984, pp. 20–33.

*Primary Examiner*—Nicholas P. Godici
*Assistant Examiner*—Samuel M. Heinrich
*Attorney, Agent, or Firm*—Charles E. Bricker; Donald J. Singer

[57] ABSTRACT

A method for fabricating an improved titanium alloy composite consisting of at least one high strength/high stiffness filament or fiber embedded in an alpha-beta titanium alloy matrix which comprises the steps of providing a rapidly-solidified foil made of an alpha-beta titanium alloy, fabricating a preform consisting of alternating layers of the rapidly-solidified foil and the filamentary material, and applying heat and pressure to consolidate the preform, wherein consolidation is carried out at a temperature below the beta-transus temperature of the alloy.

12 Claims, 3 Drawing Figures

METHOD TO PRODUCE METAL MATRIX COMPOSITE ARTICLES FROM ALPHA-BETA TITANIUM ALLOYS

RIGHTS OF THE GOVERNMENT

The invention described herein may be manufactured and used by or for the Government of the United States for all governmental purposes without the payment of any royalty.

BACKGROUND OF THE INVENTION

The present invention relates to metal/fiber composite materials, and in particular, to titanium alloy matrix composites.

Pure titanium is relatively soft, weak and extremely ductile. Through additions of other elements, the base metal is converted to an engineering material having unique characteristics, including high strength and stiffness, corrosion resistance and usable ductility, coupled with low density.

Titanium is allotropic. Up to 785° C., titanium atoms arrange themselves in a hexagonal close-packed crystal array called alpha phase. When titanium is heated above the transition temperature (beta transus) of 785° C., the atoms rearrange into a body-centered cubic structure called beta phase. The addition of other elements to a titanium base will favor one or the other of the alpha or beta forms.

Titanium alloys are classified into three major groups depending on the phases present: alpha, beta, or a combination of the two, alpha-beta. The table below lists common titanium alloy additions. The elements which favor (stabilize) the alpha phase are termed alpha stabilizers, those which favor the beta phase are termed beta stabilizers, and those which do not show a preference for either phase, but promote one or more desirable properties are termed neutral. The alpha stabilizers raise the beta transus temperature, i.e., the temperature at which the atoms rearrange from the alpha form to the beta form, and beta stabilizers lower the beta transus temperature.

| Titanium Alloy Additions | | | |
|---|---|---|---|
| Alpha | Beta Stabilizers | | |
| Stabilizers | Isomorphous | Eutectoid | Neutral |
| Al | Mo | Cr | Zr |
| O | V | Mn | Sn |
| N | Ta | Fe | |
| C | Nb | Si | |
| | | Co | |
| | | Ni | |
| | | Cu | |
| | | H | |

In recent years, material requirements for advanced aerospace applications have increased dramatically as performance demands have escalated. As a result, mechanical properties of monolithic metallic materials such as titanium alloys often have been insufficient to meet these demands. Attempts have been made to enhance the performance of titanium by reinforcement with high strength/high stiffness filaments or fibers.

Titanium matrix composites have for quite some time exhibited enhanced stiffness properties which closely approach rule-of-mixtures (ROM) values. However, with few exceptions, both tensile and fatigue strengths are well below ROM levels and are generally very inconsistent.

These titanium composites are fabricated by superplastic forming/diffusion bonding of a sandwich consisting of alternating layers of metal and fibers. At least four high strength/high stiffness filaments or fibers for reinforcing titanium alloys are commercially available: silicon carbide, silicon carbide-coated boron, boron carbide-coated boron and silicon-coated silicon carbide. Under superplastic conditions, the titanium matrix material can be made to flow without fracture occurring, thus providing intimate contact between layers of the matrix material and the fiber. The thus-contacting layers of matrix material bond together by a phenomenon known as diffusion bonding. Unfortunately, at the same time a reaction occurs at the fiber-matrix interfaces, giving rise to what is called a reaction zone. The compounds formed in the reaction zone may include reaction products like TiSi, $Ti_5Si$, TiC, TiB and $TiB_2$. The thickness of the reaction zone increases with increasing time and with increasing temperature of bonding. Titanium matrix composites have not reached their full potential, at least in part, because of problems associated with instabilities of the fiber-matrix interface. The reaction zone surrounding a filament introduces sites for easy crack initiation and propagation within the composite, which can operate in addition to existing sites introduced by the original distribution of defects in the filaments. It is well established that mechanical properties are influenced by the reaction zone, that, in general, these properties are degraded in proportion to the thickness of the reaction zone.

The cost of conventional titanium alloy foils is very high because of the many vacuum anneal/cold rolling cycles required. It is especially difficult to produce rolled foils from the alpha-beta alloy group due to their high resistance to cold deformation. Foils of the alpha-beta alloy group are particularly expensive.

It is, therefore, an object of the present invention to provide improved titanium composites.

It is another object of this invention to provide an improved method for fabricating titanium composites.

Other objects, aspects and advantages of the present invention will be apparent to those skilled in the art from a reading of the following description of the invention and the appended claims.

SUMMARY OF THE INVENTION

In accordance with the present invention there is provided an improved titanium composite consisting of at least one filamentary material selected from the group consisting of silicon carbide, silicon carbide-coated boron, boron carbide-coated boron and silicon-coated silicon carbide, embedded in an alpha-beta titanium alloy matrix.

The method of this invention comprises the steps of providing a rapidly-solidified foil made of an alpha-beta titanium alloy, fabricating a preform consisting of alternating layers of the rapidly-solidified foil and at least one of the aforementioned filamentary materials, and applying heat and pressure to consolidate the preform, wherein consolidation is carried out at a temperature below the beta-transus temperature of the alloy, thereby reducing the amount of reaction zone between the fiber and the alloy matrix.

DESCRIPTION OF THE PREFERRED EMBODIMENT

Figure 1:
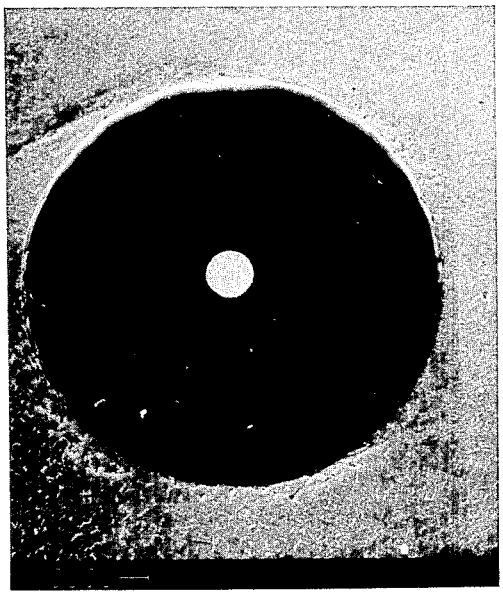
FIG. 1 is a 500× photomicrograph illustrating a portion of a Borsic/Ti-6Al-4V composite structure.

The titanium alloys employed according to the present invention are alpha-beta titanium alloys. Suitable alloys include Ti-6Al-4V, Ti-6Al-6V-2Sn, Ti-8Mn, Ti-7Al-4Mo, Ti-4.5Al-5Mo-1.5Cr, Ti-6Al-2Sn-4Zr-6Mo, Ti-5Al-2Sn-2Zr-4Mo-4Cr, Ti-6Al-2Sn-2Zr-2Mo-2Cr, Ti-5.5Al-3.5Sn-3Zr-0.3Mo-1Nb-0.3Si and Ti-5.5Al-4Sn-4Zr-0.3Mo-1Nb-0.5Si-0.06C.

Several techniques are known for producing rapidly-solidified foil, including those known in the art as Chill Block Melt Spinning (CBMS), Planar Flow Casting (PFC), melt drag (MD), Crucible Melt Extraction (CME), Melt Overflow (MO) and Pendant Drop Melt Extraction (PDME). Typically, these techniques employ a cooling rate of about $10^5$ to $10^7$ deg-K/sec and produce a material about 10 to 100 microns thick, with an average beta grain size of about 2 to 20 microns, which is substantially smaller than the beta grain size produced by ingot metallurgy methods.

The high strength/high stiffness filaments or fibers employed according to the present invention are produced by vapor deposition of boron or silicon carbide to a desired thickness onto a suitable substrate, such as carbon monofilament or very fine tungsten wire. This reinforcing filament may be further coated with boron carbide, silicon carbide or silicon. To reiterate, at east four high strength/high stiffness filaments or fibers are commercially available: silicon carbide, silicon carbide-coated boron, boron carbide-coated boron, and silicon-coated silicon carbide.

For ease of handling it is desirable to introduce the filamentary material into the composite in the form of a sheet. Such a sheet may be fabricated by laying out a plurality of filaments in parallel relation upon a suitable surface and wetting the filaments with a fugitive thermoplastic binder, such as polystyrene. After the binder has solidified, the filamentary material can be handled as one would handle any sheet-like material.

The composite preform may be fabricated in any manner known in the art. For example, alternating plies of alloy foil and filamentary material may be stacked by hand in alternating fashion. The quantity of filamentary material included in the preform should be sufficient to provide about 25 to 45, preferably about 35 volume percent of fibers.

Consolidation of the filament/sheetstock preform is accomplished by application of heat and pressure over a period of time during which the matrix material is superplastically formed around the filaments to completely embed the filaments. Prior to consolidation, the fugitive binder, if used, must be removed without pyrolysis occurring. By utilizing a press equipped with heatable platens and a vacuum chamber surrounding at least the platens and press ram(s), removal of the binder and consolidation may be accomplished without having to relocate the preform from one piece of equipment to another.

The preform is placed in the press between the heatable platens and the vacuum chamber is evacuated. Heat is then applied gradually to cleanly off-gas the fugitive binder without pyrolysis occurring, if such fugitive binder is used. After consolidation temperature is reached, pressure is applied to achieve consolidation.

Consolidation is carried out at a temperature in the approximate range of 100° to 300° C. (180° to 540° F.) below the beta-transus temperature of the titanium alloy. For example, the consolidation of a composite comprising Ti-6Al-4V alloy, which has a beta transus of about 995° C. (1825° F.), is preferably carried out at about 730° C. (1350° F.). The pressure required for consolidation of the composite ranges from about 10 to about 100 MPa (about 1.5 to 15 Ksi) and the time for consolidation ranges from about 15 minutes to 24 hours or more. Consolidation under these conditions permits retention of the fine grain size of the alloy matrix.

The following example illustrates the invention:

EXAMPLE

A first composite preform was prepared as follows:

Ti-6Al-4V ribbons produced by the pendant drop melt extraction (PDME) process, having a width of 2 mm., an average thickness of 63 microns and an average grain size of 4 microns, were cut into segments of about 1 inch length. A layer of such segments was placed into a carburized steel cup lined with CP titanium foil. Borsic fibers were placed on top of the ribbon segments. Another layer of the ribbon segments was placed over the fibers. Finally, a CP titanium foil cover was placed over the preform. A plug of carburized steel was fitted into the cup and the entire assembly was fitted into a die for hot pressing.

Figure 2:
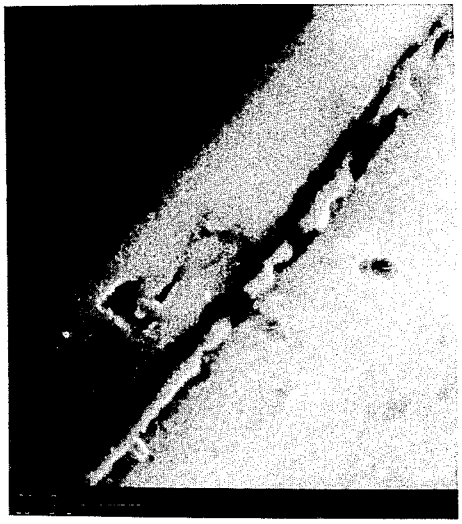
FIG. 2 is a 1000× photomicrograph of the fiber/-metal interface of the composite of FIG. 1.

The preform was compacted at 730° C. (1350° F.) at 10 Ksi for 24 hours. The resulting composite is shown in FIG. 1 which illustrates complete bonding between the Borsic fiber and the Ti-6Al-4V ribbon. The fine grain structure of the rapidly solidified ribbon (average grain size 4 microns) may also be seen. FIG. 2 illustrates the fiber/alloy interface of this composite at higher magnification with about 0.3 micron reaction zone visible.

Figure 3:
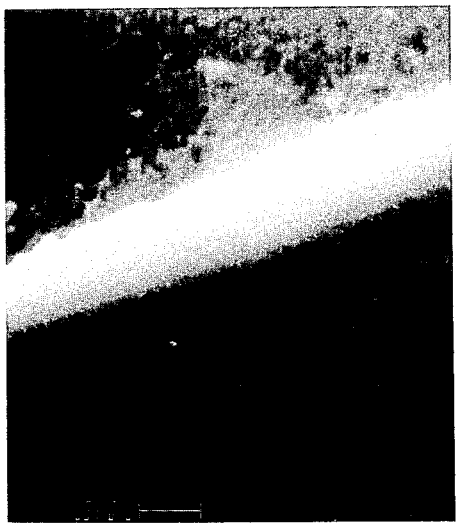
FIG. 3 is a 1000× photomicrograph showing the interface between SCS-6 fiber and rapidly solidified Ti-6Al-4V foil.

FIG. 3 illustrates the interface between Ti-6Al-4V and SCS-6 fiber of a composite prepared and consolidated as described above. No reaction zone is visible.

In contrast, composites prepared using rolled Ti-6Al-4V foil and Borsic and SCS-6 fibers, and consolidated at 925° C. (1700° F.)/8 Ksi/2 hr had reaction zones about 1 micron wide.

Various modifications may be made in the present invention without departing from the spirit of the invention or the scope of the appended claims.

We claim:

1. A method for fabricating a titanium alloy composite consisting of at least one filamentary material selected from the group consisting of silicon carbide, silicon carbide-coated boron, boron carbide-coated boron, and silicon-coated silicon carbide, and an alpha-beta titanium alloy which comprises the steps of:

(a) providing a rapidly solidified foil of said alloy;

(b) fabricating a preform consisting of alternating layers of at least one of said filamentary materials and said foil; and (c) applying heat at a level about 100° to 300° C. below the beta transus temperature of said alloy and a pressure of about 1.5 to 15 ksi for about 0.2 to 24 hours to consolidate said preform.

2. The method of claim 1 wherein said alloy is Ti-6Al-4V.

3. The method of claim 2 wherein said preform is consolidated at 730° C. at 10 ksi for 24 hours.

4. The method of claim 1 wherein said alloy is Ti-6Al-6V-2Sn.

5. The method of claim 1 wherein said alloy is Ti-8Mn.

6. The method of claim 1 wherein said alloy is Ti-7Al-4Mo.

7. The method of claim 1 wherein said alloy is Ti-4.5Al-5Mo-1.5Cr.

8. The method of claim 1 wherein said alloy is Ti-6Al-2Sn-4Zr-6Mo.

9. The method of claim 1 wherein said alloy is Ti-5Al-2Sn-2Zr-4Mo-4Cr.

10. The method of claim 1 wherein said alloy is Ti-6Al-2Sn-2Zr-2Mo-2Cr.

11. The method of claim 1 wherein said alloy is Ti-5.5Al-3.5Sn-3Zr-0.3Mo-1Nb-0.3Si.

12. The method of claim 1 wherein said alloy is Ti-5.5Al-4Sn-4Zr-0.3Mo-1Nb-0.5Si-0.06C.

* * * * *